United States Patent [19]

Froese

[11] Patent Number: 4,574,421

[45] Date of Patent: Mar. 11, 1986

[54] LOCKING BARS FOR VACUUM CLEANER

[76] Inventor: Harold L. Froese, 1509 Ousleydale Rd., Hartsville, S.C. 29550

[21] Appl. No.: 666,110

[22] Filed: Oct. 29, 1984

[51] Int. Cl.[4] ..... A47L 9/00

[52] U.S. Cl. ..... 15/339; 15/327 F; 15/257 A; 16/DIG. 24; 206/501; 206/510; 220/4 D; 220/94 R; 248/154; 248/505; 292/259 R

[58] Field of Search ..... 15/257 A, 257 R, 339; 16/114 R, DIG. 24; 206/501, 510; 220/4 C, 4 D, 94 R; 248/154, 505; 292/259 R; 294/15

[56] References Cited

U.S. PATENT DOCUMENTS

| | | | |
|---|---|---|---|
| 862,908 | 8/1907 | Hawkinson | 292/259 |
| 1,519,874 | 12/1924 | Page | 220/4 D |
| 2,033,833 | 3/1936 | Kent | 15/339 X |
| 2,817,552 | 12/1957 | Bruel | 292/259 |
| 2,888,970 | 6/1959 | Seaver | 220/4 C |
| 3,144,016 | 8/1964 | Basci | 220/4 D |
| 3,266,765 | 8/1966 | Campbell | 248/154 |
| 4,036,346 | 7/1977 | Livingston | 15/300 A |

*Primary Examiner*—Chris K. Moore
*Attorney, Agent, or Firm*—Mills and Coats

[57] ABSTRACT

The present invention relates to a vacuum cleaner locking device that is particularly adapted to lock an industrial vacuum cleaner of the type having an upper container and lower container disposed in a stacked relationship wherein each container includes a pair of handles which are aligned with the handles of the other container. The vacuum cleaner locking device includes a pair of L-shaped locking bars having vertical and horizontal sections. Each vertical section extends vertically along one side of the vacuum cleaner and through a respective handle on the upper container and engages a respective handle on the lower container. A hook is formed in the lower end of each vertical section for extending around and underneath the respective lower handles for engaging the same. The horizontal sections extend from the upper end of the vertical section over the top of the upper container to a point where they meet. At this point the ends of the horizontal sections turn upward and abut against each other. A hole is drilled through the upward portion of the horizontal sections so that a padlock can be inserted through the same. Therefore, once the hooks are engaged with the lower handles and a padlock is inserted through the holes in the upward portion of the horizontal sections, the upper container cannot be lifted from the lower container but is restrained by the L-shaped locking bars.

2 Claims, 2 Drawing Figures

LOCKING BARS FOR VACUUM CLEANERcl

FIELD OF INVENTION

The present invention relates to apparatuses for locking vacuum cleaners and more particularly to apparatuses for locking industrial cannister type vacuum cleaners used in the cleanup of nuclear reactors.

BACKGROUND OF INVENTION

In various nuclear power facilities across the country, industrial cannister type vacuum cleaners are used to cleanup the facilities after the occurrence of radioactive leakage or other similar nuclear incidents. Invariably, the dust and other debris picked up by these vacuums are contaminated by nuclear radiation. Understandably, it is desired to prevent anyone from opening these vacuum cleaners and possibly subjecting themselves to the contamination. This is particularly true in light of the fact that workers frequently break into these vacuum cleaners to recover rings, coins, etc., which have been inadvertently picked up by the vacuum cleaner. Although these vacuum cleaners are frequently provided with means for locking the same, they have proved ineffective in preventing access to the vacuum bags contained therein.

SUMMARY AND OBJECTS OF INVENTION

The present invention presents an apparatus for locking industrial cannister type vacuum cleaners. Provided is a pair of L-shaped locking bars having vertical and horizontal sections or members. The vertical members extend through respective handles on the upper container of the vacuum cleaner and engage respective handles on the lower container. The horizontal members extend over the upper container and meet at a point above the same. A lock may be inserted through holes drilled into the horizontal members thereby securing the same together. Thus the upper container is securely stationed to the lower container by the locking bar which is engaged with the handle of the lower container and extends over the upper container.

Accordingly, it is an object of the present invention to prevent unauthorized access to the vacuum cleaner bags of industrial cannister type vacuum cleaners used to cleanup nuclear reactors.

It is another object of this invention to achieve the preceding object with a device that engages the lower container and extends over the upper container to prevent separation of the containers and hence, access to the vacuum cleaner bags.

It is another object of the invention to achieve the preceding objects with a device that is simple and which can be easily and relatively inexpensively manufactured from common materials.

A further object of the present invention is to provide a locking bar assembly for an industrial type vacuum cleaner that is easy to mount and install on the vacuum cleaner but which cannot easily be removed from the vacuum cleaner withour following appropriate unlocking procedures.

Other objects and advantages of the present invention will become apparent from a review of the following description and accompanying drawings.

DESCRIPTION OF INVENTION

With further reference to the drawings it is seen that the vacuum cleaner locking device of the present invention is shown therein and indicated generally by the numeral 10.

Figure 2:
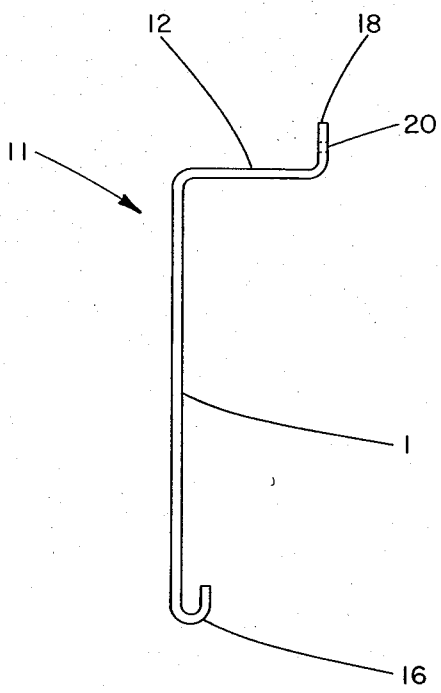
FIG. 2 is a side elevational view of one locking bar of the locking device of the present invention.

Viewing vacuum cleaner locking device 10 in more detail it is seen that the same includes pair of locking bars referred to generally by the numeral 11. Locking bars 11 include a horizontal restraining member or section 12 and a vertical hooking member or section 14. Restraining member 12 and hooking member 14 are joined (or bent) to form generally right angles. A hook 16 is formed about the lower end of each hooking member 14 as viewed in FIG. 2. A locking plate 18 is formed about the free end of each restraining member 12 and extends upwardly a short distance therefrom at a 90° angle (See FIG. 2). A lock hole 20 is drilled through each lock plate 18.

Figure 1:
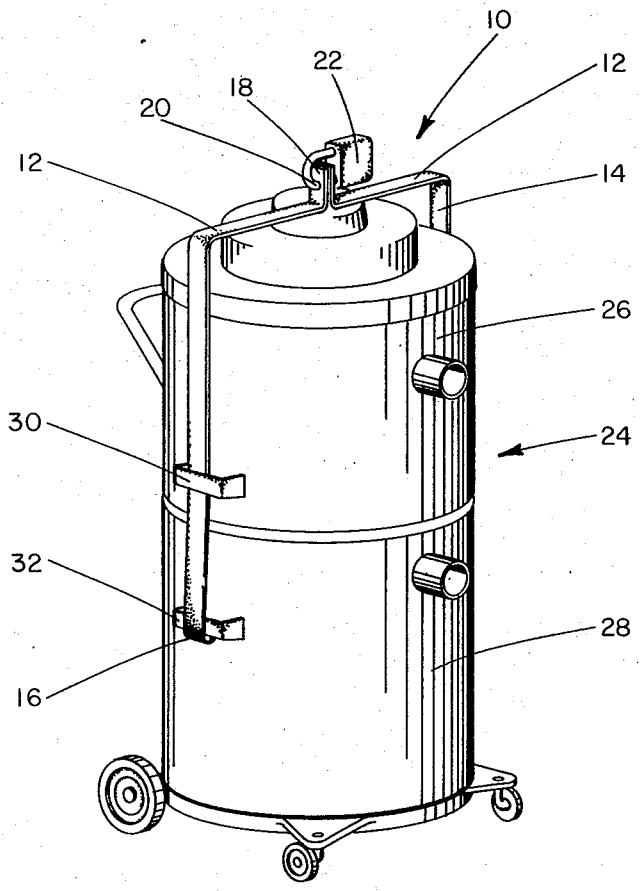
FIG. 1 is a perspective view of an industrial cannister type vacuum cleaner with the locking device of the present invention secured thereto.

Locking device 10 provides an easy and effective means for locking an industrial cannister type vacuum cleaner 24 similar to the one illustrated in FIG. 1.

Briefly viewing vacuum cleaner 24, it is of the cannister type and includes separable upper and lower containers 25 and 28, respectively. Access may be gained to the internal bag area of the vacuum cleaner 24 by lifting upper container 26 from lower container 28.

To use locking device 10, the hooking member 14 of each locking bar 11 is extended through the upper handle 30 of the upper container 26. Each hook 16 is then extended around and underneath the lower handles 32 of lower container 28 to engage the same. (See FIG. 1). Once hooks 16 are engaged with lower handles 32, restraining members 12 should extend across and against the top of upper container 26. In this position, locking plates 18 should be disposed adjacent to each other so that lock holes 20 align. An ordinary padlock 22 can then be inserted through lock holes 20 to secure locking bars 11 in place and to prevent the upper container 26 from being separated from the lower container.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A vacuum cleaner locking bar assembly for particularly locking an industrial vacuum cleaner of the type having separable upper and lower containers diposed in a stacked relationship wherein each container includes a pair of handles aligned with the handles of the other container comprising: a pair of integrally formed rigid locking bars with each locking bar being rigid and of a generally L-shape and having a turned up lock end and a hook end for securing and locking said upper container to said lower container, each said locking bar further including a rigid restraining section disposed adjacent to said turned up lock end and forming a right angle therewith and a rigid hooking section disposed adjacent to said hook end and forming a rigid right angle with said restraining section, each locking bar further including a lock hole formed in the lock end of each of said locking bars, and wherein each hooking member extends interiorly through a respective handle on said upper container and wherein each hook end includes a hook member that extends exteriorly past a respective handle on said lower container and which hooks underneath and back through the same handle and wherein each restraining section extends over said upper container so that said turned up lock ends align and abut against each other such that said lock holes formed in the same align; and a padlock for interlocking said locking bars about said vacuum cleaner, said padlock extending through each lock hole and operative to couple said locking bars about said vacuum cleaner.

2. A vacuum cleaner locking device for locking an industrial vacuum cleaner of the type having separable upper and lower containers disposed in a stack relationship wherein each container includes a pair of handles which are aligned with the handles of the other container, said vacuum cleaner locking device when disposed in a locked position comprising: a pair of mating, rigid, and generally L-shaped locking bars for securing and holding said upper container downwardly onto said lower container, said rigid generally L-shaped locking bars including vertical member means for extending downwardly adjacent said upper and lower containers for engaging and attaching to respective handles on said lower container, and horizontal restraining means extending inwardly from the top portion of said vertical member means and which extend across the top of said upper container for securing the top container to said lower container, said vertical member means including a pair of vertical members extending downwardly through the handles on said upper container and wherein each vertical member includes a lower hook thereon for actually engaging and hooking a respective handle on said lower container; said horizontal restraining means including a pair of horizontal members that extend inwardly from said vertical members with each horizontal member including an inwardly disposed locking end; and means for interlocking said locking bars about said vacuum cleaner so as to secure said locking bars to said vacuum cleaner and for locking and securing said upper container onto said lower container, said means for interlocking said locking bars including padlocking means secured to said locking ends of said horizontal members for actually securing one locking end of one L-shaped bar to the locking end of another L-shaped bar.

* * * * *